United States Patent [19]

Uthoff, Jr.

[11] Patent Number: 4,609,335

[45] Date of Patent: Sep. 2, 1986

[54] SUPERCHARGER WITH REDUCED NOISE AND IMPROVED EFFICIENCY

[75] Inventor: Loren H. Uthoff, Jr., Canton, Mich.

[73] Assignee: Eaton Corporation, Cleveland, Ohio

[21] Appl. No.: 652,536

[22] Filed: Sep. 20, 1984

[51] Int. Cl.[4] ..... F01C 1/08; F01C 1/16

[52] U.S. Cl. ..... 418/201; 418/206

[58] Field of Search ..... 418/201-206

[56] References Cited

U.S. PATENT DOCUMENTS

| | | | |
|---|---|---|---|
| 1,746,885 | 2/1930 | Bunge et al. | 418/206 |
| 2,014,932 | 9/1935 | Hallett | 418/83 |
| 2,028,414 | 1/1936 | Schneider | 418/200 |
| 2,078,334 | 4/1937 | Martocello | 418/203 |
| 2,259,027 | 10/1941 | De Zarate et al. | 418/206 |
| 2,448,901 | 8/1943 | McCulloch et al. | 418/206 |
| 2,454,048 | 11/1948 | Flanagan | 418/206 |
| 2,463,080 | 2/1945 | Beier | 418/206 |
| 2,480,818 | 8/1949 | Whitfield | 103/128 |
| 2,701,683 | 2/1955 | Whitfield | 418/201 |
| 2,906,448 | 9/1959 | Lorenz | 418/85 |
| 3,058,652 | 10/1962 | Glamann | 418/206 |
| 3,121,529 | 2/1964 | Hubrich | 418/203 |
| 3,531,227 | 9/1970 | Weatherston | 418/94 |
| 3,667,874 | 6/1972 | Weatherston et al. | 418/9 |
| 3,844,695 | 10/1974 | Weatherston | 418/180 |
| 4,042,062 | 8/1977 | Tooley | 181/36 |
| 4,135,602 | 1/1979 | Clark | 181/230 |
| 4,215,977 | 8/1980 | Weatherston | 418/1 |

*Primary Examiner*—Leonard E. Smith
*Assistant Examiner*—Jane E. Obee
*Attorney, Agent, or Firm*—C. H. Grace; P. S. Rulon

[57] ABSTRACT

An improved supercharger or blower (10) of the Roots-type with reduced airborne noise and improved efficiency. The blower includes a housing (12) defining generally cylindrical chambers (32, 34) containing meshed lobed rotors (14, 16) having the lobes (14*a*, 14*b*, 14*c*, 16*a*, 16*b*, 16*c*) thereon formed with an end-to-end helical twist according to the relation 360°/2n, where n equals the number of lobes per rotor. In one embodiment, blower housing (12) also defines inlet and outlet ports (36, 38). The inlet port includes longitudinal boundaries defined by housing wall surfaces (20*f*, 20*h*) and transverse boundaries defined by housing wall surfaces (20*g*, 20*i*). The transverse boundaries (20*g*, 20*i*) are disposed substantially parallel to the helical lobes. The outlet port includes longitudinal boundaries defined by housing surfaces (20*m*, 20*r*) and a transverse boundaries defined by housing surfaces (20*p*, 20*s*). The inlet and outlet port openings are skewed in opposite directions to increase the time top lands of the lobes are in sealing relation with cylindrical walls (20*a*, 20*b*) of chambers (32, 34). Expanding orifices (42, 44) defined by the intersection of transverse boundaries (20*p*, 20*s*) and longitudinal boundary (20*m*) are disposed substantially midway between ends (14*g*, 14*h* and 16*g*, 16*h*) of the lobe lands to reduce backflow noise.

13 Claims, 9 Drawing Figures

FIG. 2.
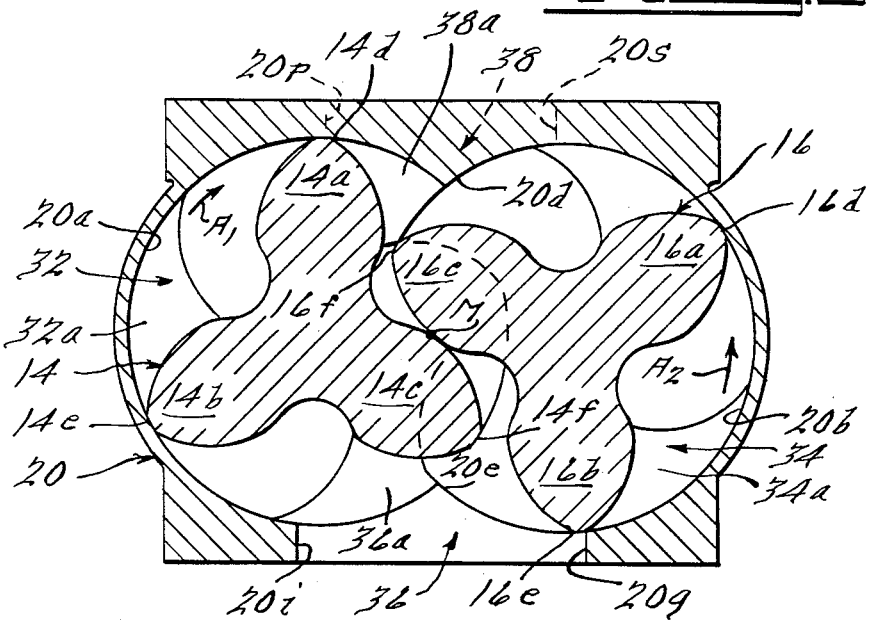
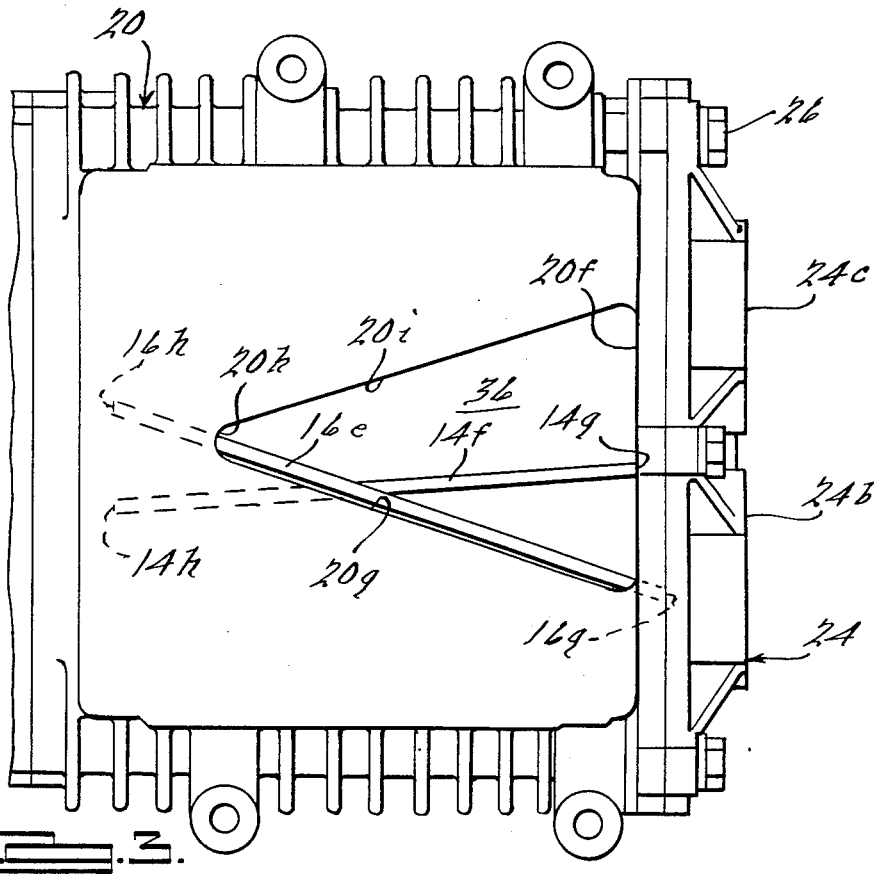
FIG. 3.

FIG. 4.
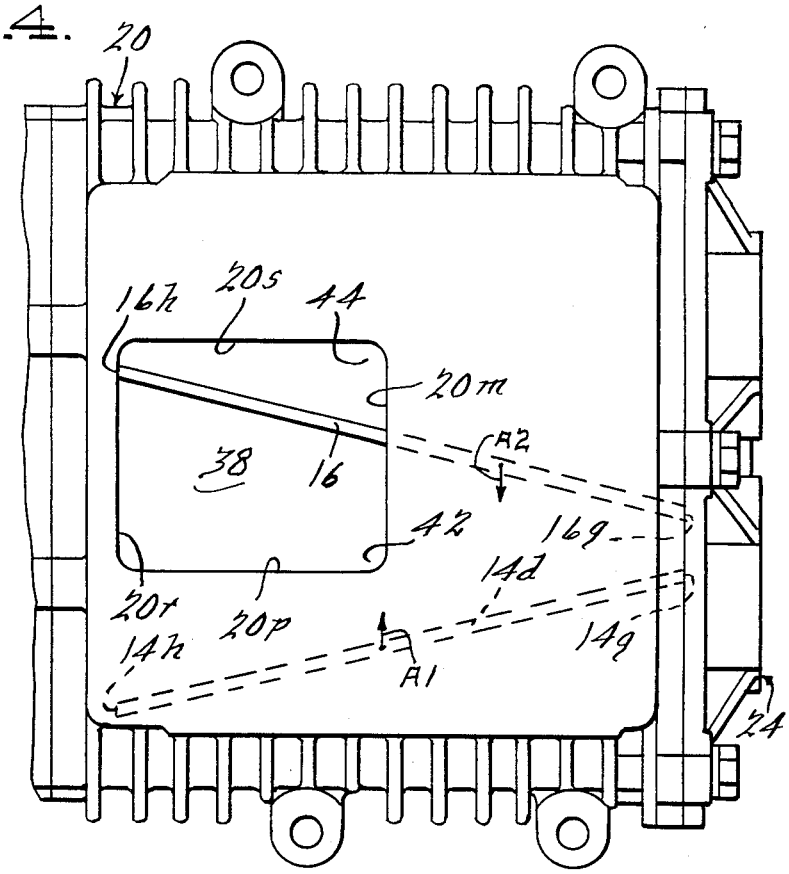
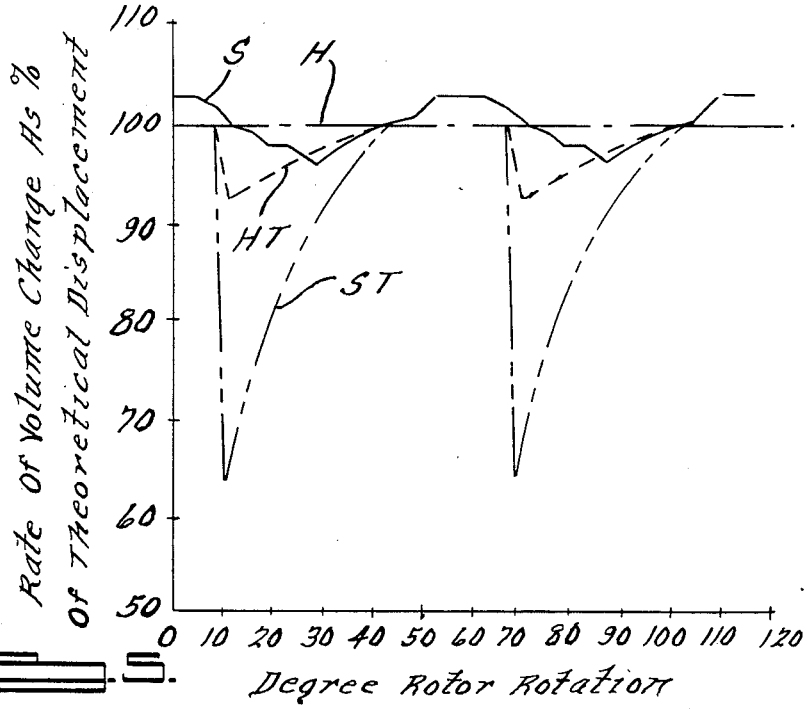
FIG. 5.

SUPERCHARGER WITH REDUCED NOISE AND IMPROVED EFFICIENCY

CROSS-REFERENCE TO RELATED APPLICATIONS

The invention of this application relates to U.S. application Ser. Nos. 647,071, and 647,072, filed Sept. 4, 1984. These applications are assigned to the assignee of this application.

BACKGROUND OF THE INVENTION

1. Field of the Invention

This invention relates to rotary compressors or blowers, particularly to blowers of the backflow type. More specifically, the present invention relates to reducing airborne noise associated with Roots-type blowers employed as superchargers for internal combustion engines.

2. Description of the Prior Art

Rotary blowers particularly Roots-type blowers are characterized by noisy operation. The blower noise may be roughly classified into two groups: solid borne noise caused by rotation of timing gears and rotor shaft bearings subjected to fluctuating loads, and fluid borne noise caused by fluid flow characteristics such as rapid changes in fluid velocity. Fluctuating fluid flow contributes to both solid and fluid borne noise.

As is well-known, Roots-type blowers are similar to gear-type pumps in that both employ toothed or lobed rotors meshingly disposed in transversely overlapping cylindrical chambers. Top lands of the lobes sealingly cooperate with the inner surfaces of the cylindrical chambers to trap and transfer volumes of fluid between adjacent lobes on each rotor. Roots-type blowers are used almost exclusively to pump or transfer volumes of compressible fluids, such as air, from an inlet receiver chamber to an outlet receiver chamber. Normally, the inlet chamber continuously communicates with an inlet port and the outlet chamber continuously communicates with an outlet port. The inlet and outlet ports often have a transverse width nominally equal to the transverse distance between the axes of the rotors. Hence, the cylindrical wall surfaces on either side of the ports are nominally 180° in arc length. Each receiver chamber volume is defined by the inner boundary of the associated port, the meshing interface of the lobes, and sealing lines between the top lands of the lobes and cylindrical wall surfaces. The inlet receiver chamber expands and contracts between maximum and minimum volumes while the outlet receiver chamber contracts and expands between like minimum and maximum volumes. In most Roots-type blowers, transfer volumes are moved to the outlet receiver chamber without compression of the air therein by mechanical reduction of the transfer volume size. If outlet port air pressure is greater than the air pressure in the transfer volume, outlet port air rushes or backflows into the volumes as they become exposed to or merged into the outlet receiver chamber. Backflow continues until pressure equalization is reached. The amount of backflow air and rate of backflow are, of course, a function of pressure differential. Backflow into one transfer volume which ceases before backflow starts into the next transfer volume, or which varies in rate, is said to be cyclic and is a known major source of airborne noise.

Another major source of airborne noise is cyclic variations in volumetric displacement or nonuniform displacement of the blower. Nonuniform displacement is caused by cyclic variations in the rate of volume change of the receiver chamber due to meshing geometry of the lobes and due to trapped volumes between the meshing lobes. During each mesh of the lobes first and second trapped volumes are formed. The first trapped volumes contain outlet port or receiver chamber air which is abruptly removed from the outlet receiver chamber as the lobes move into mesh and abruptly returned or carried back to the inlet receiver chamber as the lobes move out of mesh. As the differential pressure between the receiver chambers increases, so does the mass of carry-over air to the inlet receiver chamber with corresponding increases in the rate of volume change in the receiver chambers and corresponding increases in airborne noise. Further, blower efficiency decreases as the mass of carry-over air increases.

The trapped volumes are further sources of airborne noise and inefficiency for both straight and helical lobed rotors. With straight lobed rotors, both the first and second trapped volumes are formed along the entire length of the lobes, whereas with helical lobes rotors, the trapped volumes are formed along only a portion of the length of the lobes with a resulting decrease in the degrading effects on noise and inefficiency. The first trapped volumes contain outlet port air and decrease in size from a maximum to a minimum, with a resulting compressing of the fluid therein. The second trapped volumes are substantially void of fluid and increase in size from a minimum to a maximum with a resulting vacuum tending expansion of fluid therein. The resulting compression of air in the first trapped volumes, which are subsequently expanded back into the inlet port, and expansion of the second trapped volumes are sources of airborne noise and inefficiencies.

Many prior art patents have addressed the problems of airborne noise. For example, it has long been known that nonuniform displacement, due to meshing geometry, is greater when rotor lobes are straight or parallel to the rotor axes and that substantially uniform displacement is provided when the rotor lobes are helically twisted. U.S. Pat. No. 2,014,932 to Hallett teaches substantially uniform displacement with a Roots-type blower having two rotors and three 60° helical twist lobes per rotor. Theoretically, such helical lobes could or would provide uniform displacement were it not for cyclic backflow and trapped volumes. Nonuniform displacement, due to trapped volumes, is of little or no concern with respect to the Hallett blower since the lobe profiles therein inherently minimize the size of the trapped volumes. However, such lobe profiles, in combination with the the helical twist, can be difficult to accurately manufacture and accurately time with respect to each other when the blowers are assembled.

Hallett also addressed the backflow problem and proposed reducing the initial rate of backflow to reduce the instantaneous magnitude of the backflow pulses. This was done by a mismatched or rectangular shaped outlet port having two sides parallel to the rotor axes and, therefore, skewed relative to the traversing top lands of the helical lobes. U.S. Pat. No. 2,463,080 to Beier discloses a related backflow solution for a straight lobe blower by employing a triangular outlet port having two sides skewed relative to the rotor axes and, therefore, mismatched relative to the traversing lands of the straight lobes. The arrangement of Hallett and Beier slowed the initial rate of backflow into the transfer volume and therefore reduced the instantaneous magnitude of the backflow. However, neither teaches nor suggests controlling the rate of backflow so as to obtain a continuous and constant rate of backflow.

Several other prior art U.S. patents have also addressed the backflow problem by preflowing outlet port or receiver chamber air into the transfer volumes before the lands of the leading lobe of each transfer volume traverses the outer boundary of the outlet port. In some of these patents, preflow is provided by passages of fixed flow area through the cylindrical walls of the housing sealing cooperating with the top lands of the rotor lobes. Since the passages are of fixed flow area, the rate of preflow decreases with decreasing differential pressure. Hence, the rate of preflow is not constant.

U.S. Pat. No. 4,215,977 to Weatherston discloses preflow and purports to provide a Roots-type blower having uniform displacement. However, the lobes of Weatherston are straight and, therefore, believed incapable of providing uniform displacement due to meshing geometry.

The Weatherston blower provides preflow of outlet receiver chamber air to the transfer volumes via circumferentially disposed, arcuate channels or slots formed in the inner surfaces of the cylindrical walls which sealingly cooperate with the top lands of the rotor lobes. The top lands and channels cooperate to define orifices for directing outlet receiver chamber air into the transfer volumes. The arc or setback length of the channels determines the beginning of preflow. Weatherston suggests the use of additional channels of lesser setback length to hold the rate of preflow relatively constant as pressure in the transfer volumes increases. The Weatherston preflow arrangement, which is analogous to backflow, is believed theoretically capable of providing a relatively constant preflow rate for predetermined blower speeds and differential pressures. However, to obtain relatively constant preflow, several channels of different setback length would be necessary. Further, accurate and consistent forming of the several channels on the interior surface of the cylindrical walls is, at best, an added manufacturing cost.

The prior efforts of Hallett, Beier, and Weatherston have, in some cases, provided less than optimum reduction in airborne noise and, in some cases, reduced volumetric efficiency of the blowers. These disadvantages are greatly reduced by employing helically lobed rotors with backflow into the transfer volumes provided by expanding orifices integral with the outlet port and disposed substantially midway between the ends of the helical lobes. This arrangement decreases the distance backflow air has to travel between the adjacent lobes of each transfer volume and increases the time or number of rotational degrees the rotor lands are in sealing relation with the cylindrical walls of the rotor chambers.

SUMMARY OF THE INVENTION

An object of this invention is to provide a rotary blower of the backflow type for compressible fluids which has a relatively high volumetric efficiency and which is relatively free of airborne noise.

According to an important feature of the present invention, a rotary blower of the backflow type includes a housing defining two parallel, traversely overlapping chambers having cylindrical and end wall surfaces; an inlet port and an outlet port having longitudinal and transverse boundaries defined by openings in opposite sides of the housing with the transverse boundary of each port disposed on opposite sides of a plane extending through the intersection of the chambers; meshed, lobed rotors disposed in the chambers with the lobes of each rotor having top lands sealingly cooperating with the cylindrical wall surfaces of the associated chamber and operative to traverse the port boundaries disposed on the associated side of the plane for effecting transfer of volumes of compressible inlet port fluid to the outlet port via spaces between adjacent unmeshed lobes of each rotor; the lobes being formed with a helical twist whereby each land has a lead end and a trailing end in the direction of rotor rotation. The improvement comprises the inlet port opening being skewed toward the lead ends of the lands; and the outlet port opening being skewed toward the trailing ends of the lands and having an expanding orifice on either side of the plane defined by intersections of the boundaries and traversing of the intersections by the lands of the associated lobes, the orifices being disposed substantially midway between the land ends.

BRIEF DESCRIPTION OF THE DRAWINGS

A Roots-type blower intended for use as a supercharger is illustrated in the accompanying drawings in which:

FIG. 2 is a schematic sectional view of the blower looking along line 2—2 of FIG. 1;

FIG. 3 is a bottom view of a portion of the blower looking in the direction of arrow 3 in FIG. 1 and illustrating an inlet port configuration;

FIG. 4 is a top view of a portion of the blower looking in the direction of arrow 4 of FIG. 1 and illustrating an outlet port configuration;

FIG. 5 is a graph illustrating operational characteristics of the blower.

DETAILED DESCRIPTION OF THE DRAWINGS

Figure 1:
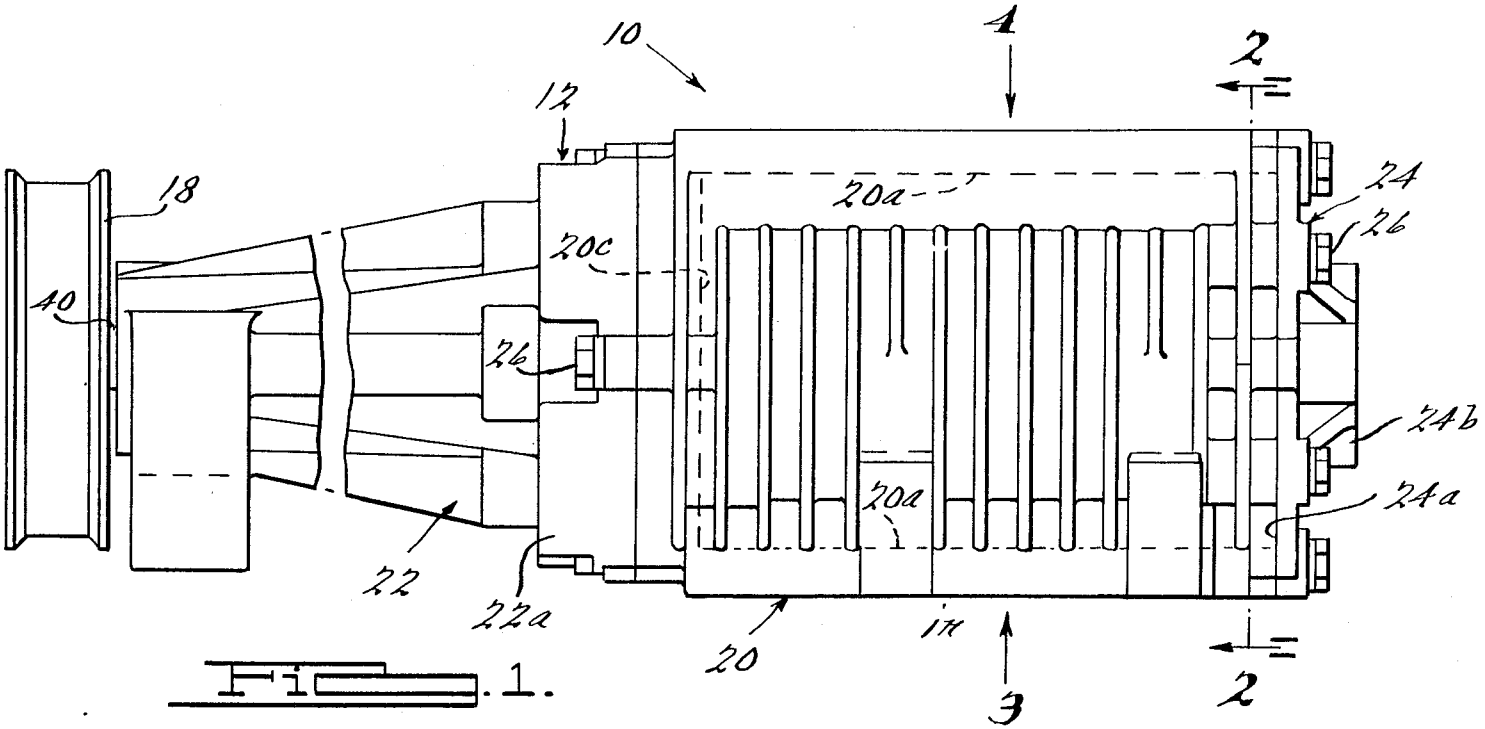
FIG. 1 is a side elevational view of the Roots-type blower.

FIGS. 1–4 illustrate a rotary pump or blower 10 of the Roots-type. As previously mentioned, such blowers are used almost exclusively to pump or transfer volumes of compressible fluid, such as air, from an inlet port to an outlet port without compressing the transfer volumes prior to exposure to the outlet port. The rotors operate somewhat like gear-type pumps, i.e., as the rotor teeth or lobes move out of mesh, air flows into volumes or spaces defined by adjacent lobes on each rotor. The air in the volumes is then trapped therein at substantially inlet pressure when the top lands of the trailing lobe of each transfer volume moves into a sealing relation with the cylindrical wall surfaces of the associated chamber. The volumes of air are transferred or exposed to outlet air when the top land of the leading lobe of each volume moves out of sealing relation with the cylindrical wall surfaces by traversing the boundary of the outlet port. If the volume of the transfer volumes remains constant during the trip from inlet to outlet, the air therein remains at inlet pressure, i.e., transfer volume air pressure remains constant if the top lands of the leading lobes traverse the outlet port boundary before the volumes are squeezed by virtue of remeshing of the lobes. Hence, if air pressure at the discharge port is greater than inlet port pressure, outlet port air rushes or backflows into the transfer volumes as the top lands of the leading lobes traverse the outlet port boundary.

Blower 10 includes a housing assembly 12, a pair of lobed rotors 14, 16, and an input drive pulley 18. Housing assembly 12, as viewed in FIG. 1, includes a center section 20, and left and right end sections 22, 24 secured to opposite ends of the center section by a plurality of bolts 26. The rotors rotate in opposite directions as shown by the arrows $A_1$, $A_2$. The housing assembly and rotors are preferably formed from a lightweight material such as aluminum. The center section and end 24 define a pair of generally cylindrical working chambers 32, 34 circumferentially defined by cylindrical wall portions or surfaces 20*a*, 20*b*, an end wall surface indicated by phantom line 20*c* in FIG. 1, and an end wall surface 24*a*. Chambers 32, 34 traversely overlap or intersect at cusps 20*d*, 20*e*, as seen in FIG. 2. Cusps 20*d*, 20*e* extend longitudinally in parallel with the axes of the rotors, and define an imaginary and unshown plane which in FIG. 2, would appear as a vertical line of infinite length. Openings 36, 38 in the bottom and top of center section 20 respectively define the transverse and longitudinal boundaries of inlet and outlet ports.

Rotors 14, 16 respectively include three circumferentially spaced apart helical teeth or lobes 14*a*, 14*b*, 14*c* and 16*a*, 16*b*, 16*c* of modified involute profile with an end-to-end twist of 60°. The lobes or teeth mesh and preferably do not touch. A sealing interface between meshing lobes 14*c*, 16*c* is represented by point M in FIG. 2. Interface or point M moves along the lobe profiles as the lobes progress through each mesh cycle and may be defined in several places. The lobes also include top lands 14*d*, 14*e*, 14*f*, and 16*d*, 16*e*, 16*f*. The lands move in close sealing noncontacting relation with cylindrical wall surfaces 20*a*, 20*b* and with the root portions of the lobes they are in mesh with. Since the lobes are helical, an end 14*g*, 16*g* of each lobe on each rotor leads the other end 14*h*, 16*h* in the direction of rotor rotation. Rotors 14, 16 are respectively mounted for rotation in cylindrical chambers 32, 34 about axes coincident with the longitudinally extending, transversely spaced apart, parallel axes of the cylindrical chambers. Such mountings are well-known in the art. Hence, it should suffice to say that unshown shaft ends extending from and fixed to the rotors are supported by unshown bearings carried by end wall 20*c* and end section 24. Bearings for carrying the shaft ends extending rightwardly into end section 24 are carried by outwardly projecting bosses 24*b*, 24*c*. The rotors may be mounted and timed as shown in U.S. patent application Ser. No. 506,075, filed June 20, 1983, now abandoned in favor of continuation application Ser. No. 775,556, filed Sept. 13, 1985, and incorporated herein by reference. Rotor 16 is directly driven by pulley 18 which is fixed to the left end of a shaft 40. Shaft 40 is either connected to or an extension of the shaft end extending from the left end of rotor 16. Rotor 14 is driven in a conventional manner by unshown timing gears fixed to the shaft ends extending from the left ends of the rotors. The timing gears are of the substantially no backlash type and are disposed in a chamber defined by a portion 22*a* of end section 22.

The rotors, as previously mentioned, have three circumferentially spaced lobes of modified involute profile with an end-to-end helical twist of 60°. Rotors with other than three lobes, with different profiles and with different twist angles, may be used to practice certain aspects or features of the inventions disclosed herein. However, to obtain uniform displacement based on meshing geometry and trapped volumes, the lobes are preferably provided with a helical twist from end-to-end which is substantially equal to the relation 360°/2n, where n equals the number of lobes per rotor. Further, involute profiles are also preferred since such profiles are more readily and accurately formed than most other profiles; this is particularly true for helically twisted lobes. Still further, involute profiles are preferred since they have been more readily and accurately timed during supercharger assembly.

As may be seen in FIG. 2, the rotor lobes and cylindrical wall surfaces sealingly cooperate to define an inlet receiver chamber 36*a*, an outlet receiver chamber 38*a*, and transfer volumes 32*a*, 34*a*. For the rotor positions of FIG. 2, inlet receiver chamber 36*a* is defined by portions of the cylindrical wall surfaces disposed between top lands 14*e*, 16*e* and the lobe surfaces extending from the top lands to the interface M of meshing lobes 14*c*, 16*c*. Interface M defines the point or points of closest contact between the meshing lobes. Likewise, outlet receiver chamber 38*a* is defined by portions of the cylindrical wall surfaces disposed between top lands 14*d*, 16*d* and the lobe surfaces extending from the top lands to the interface M of meshing lobes 14*c*, 16*c*. During each meshing cycle and as previously mentioned, meshing interface M moves along the lobe profile and is often defined at several places. The cylindrical wall surfaces defining both the inlet and outlet receiver chambers include those surface portions which were removed to define the inlet and outlet port openings. Transfer volume 32*a* is defined by adjacent lobes 14*a*, 14*b* and the portion of cylindrical wall surfaces 20*a* disposed between top lands 14*d*, 14*e*. Likewise, transfer volume 34*a* is defined by adjacent lobes 16*a*, 16*b* and the portion of cylindrical wall surface 20*b* disposed between top lands 16*d*, 16*e*. As the rotors turn, transfer volumes 32*a*, 34*a* are reformed between subsequent pairs of adjacent lobes.

Inlet port 36 is provided with an opening shaped substantially like an triangle by wall surfaces 20*f*, 20*g*, 20*h*, 20*i* defined by housing section 20. Wall surfaces 20*f*, 20*h* define the longitudinal boundaries or extent of the port and wall surfaces 20*g*, 20*i* define the transverse boundaries or extent of the port. Transverse boundaries 20*g*, 20*i* are disposed on opposite sides of an unshown plane extending through the intersection of the chambers. The transverse boundaries or wall surfaces 20*g*, 20*i* are matched or substantially parallel to the traversing top lands of the lobes and the longitudinal boundary 20*f* is disposed substantially at the leading ends of the lobes or lands. This arrangement skews the major portion of the inlet port opening toward the lead end of the lands. Further, the transverse boundaries are positioned such that the lands of the associated lobes traverse wall surface 20*g*, 20*i* prior to their trailing ends traversing the unshown plane or cusp 20*e* that the plane passes through. The top lands of the helically twisted lobes in both FIGS. 3 and 4 are schematically illustrated as being diagonally straight for simplicity herein. As viewed in FIGS. 3 and 4, such lands actually have a curvature. Wall surfaces 20*g*, 20*i* may be curved to more closely conform to the helical twist of the top lands.

Outlet port 38 is provided with a rectangular opening by wall surfaces 20*m*, 20*s*, 20*p*, 20*r* defined by housing section 20. Wall surfaces 20*m*, 20*r* are parallel and define the longitudinal boundaries or extent of the port.

Wall surface 20*m* is disposed substantially midway between land ends 14*g*, 14*h* and 16*g*, 16*h* and wall surface 20*r* is disposed in line with trailing ends 14*h*, 16*h* of the lands. Wall surfaces 20*p*, 20*s* are also parallel and may be spaced further apart than shown herein if additional outlet port area is needed to prevent a pressure drop or back pressure across the outlet port. This wall surface arrangement skews the major portion of the outlet ports opening toward the trailing ends of the lobe lands. The intersections of transverse wall surfaces 20*p*, 20*s* with longitudinal wall surface 20*m* define expanding orifices 42, 44 in combination with the traversing top lands of the associated lobes. As may be seen in FIG. 4, initial traversal of the intersecting boundary portions defined by wall surfaces 20*p*, 20*s*, and 20*m* provides first communication between high pressure outlet port air and the transfer volumes. Further, the intersecting boundary portions are also disposed at angles or transverse to the helical lands while being traversed. The top lands of the rotor lobes first traverse the intersections of wall surfaces 20*m*, 20*p* and 20*m*, 20*s* and then progressively traverse the portions of the wall surfaces to define the expanding orifices. For example, land 14*d*, which is moving in the direction of arrow A1 in FIG. 4, will first traverse the intersection of the wall surfaces 20*m*, 20*p* and then progressively traverse the wall surfaces 20*m*, 20*p* adjacent to intersection to define in combination with top land 14*d* expanding triangles or orifices. Land 16*c*, which moves in the direction of arrow A2 is shown after it has traversed the intersection of wall surfaces 20*m*, 20*s* and completed traversal of adjacent wall surfaces 20*m*, 20*s* of expanding orifice 44. The expanding orifices control the rate of backflow air into the transfer volumes to lessen airborne noise due to backflow. Positioning the orifices substantially midway between the ends of the lands reduces velocity and travel distance of the backflow air, thereby further reducing airborne noise. Orifices 42, 44 may be designed to expand at a rate operative to maintain a substantially constant backflow rate of air into the transfer volumes when the blower operates at predetermined speed and differential pressure relationships.

The inlet-outlet port arrangement also decreases internal leakage in the blower or improves volumetric efficiency of the blower by increasing the time or number of rotational degrees the lobe lands defining each transfer volume are in sealing relation with the cylindrical walls of the rotor chambers. The seal time is increased by skewing the inlet and outlet ports in opposite directions, by disposing the transverse boundaries of at least the inlet port substantially parallel to the traversing lands of the associated lobes, and by positioning the expanding orifices substantially midway between the land ends. For example, the inlet-outlet port arrangement of FIGS. 3 and 4 requires that either rotor 16 or 14 rotate through an angle of approximately 85° from the point in the rotation at which rotor land 14*e* or 16*e* transverses inlet port 36 boundaries 20*i* or 20*g* before the respective transfer volumes 32*a*, 34*a* are opened to the outlet port by lands 14*d*, 16*d* transversing the expanding orifices 42, 44 thus providing approximately 85° of seal time for the lands defining each transfer volume. Hence, at even relatively slow rotor speeds in the range of 2000–6000 RPM, high pressure air leaking past land 16*d* in direct communication with outlet port air will not have sufficient time to propagate across transfer volume 34*a* before land 16*e* moves into sealing relation with cylindrical wall surface 20*b*.

Looking now for a moment at the graph of FIG. 5, therein curves S and H illustrate cyclic variations in volumetric displacement over 60° periods of rotor rotation. The variations are illustrated herein in terms of degrees of rotation but may be illustrated in terms of time. Such cyclic variations are due to the meshing geometry of the rotor lobes which effect the rate of change of volume of the outlet receiver chamber 38*a*. Since the inlet and outlet receiver chamber volumes vary at substantially the same rate and merely inverse to each other, the curves for outlet receiver chamber 38*a* should suffice to illustrate the rate of volume change for both chambers. Curve S illustrates the rate of change for a blower having three straight lobes of modified involute profile per rotor and curve H for a blower having three 60° helical twist lobes of modified involute profile per rotor. As may be seen, the absolute value of rate-of-change is approximately 7% of theoretical displacement for straight lobe rotors while there is no variation in the rate of displacement for 60° helical lobes if the trapped volumes are not considered.

The rate of volume change or uniform displacement for both straight and helical lobes, as previously mentioned, is due in part to the meshing geometry of the lobes. For straight lobes, the meshing relationship of the lobes is the same along the entire length of the lobes, i.e., the meshing relationship at any cross section or incremental volume along the meshing lobes is the same. For example, interface or point M of FIG. 2 is the same along the entire length of the meshing lobes, and a line through the points is straight and parallel to the rotor axis. Hence, a rate of volume change, due to meshing geometry, is the same and additive for all incremental volumes along the entire length of the straight, meshing lobes. This is not the case for helical lobes formed according to the relation 360°/2n. For three lobe rotors having 60° helical lobes, the meshing relationship varies along the entire length of the meshing lobes over a 60° period. For example, if the meshing lobes were divided into 60 incremental volumes along their length, 60 different meshing relationships would exist at any given time, and a specific meshing relationship, such as illustrated in FIG. 2, would first occur at one end of the meshing lobes and then be sequentially repeated for each incremental volume as the rotors turn through 60 rotational degrees. If the meshing relationship of an incremental volume at one end of meshing lobes tends to increase the rate of volume change, the meshing relationship of the incremental volume at the other end of the meshing lobes tends to decrease the rate of volume change an equal amount. This additive-substractive or canceling relationship exists along the entire length of the meshing lobes and thereby cancels rates of volume change or provides uniform displacement with respect to meshing geometry.

Volumes of fluid trapped between meshing lobes are another cause or source affecting the rate of cyclic volume change of the receiver chambers. The trapped volumes are abruptly removed from the outlet receiver chamber and abruptly returned or carried back to the inlet receiver chamber. The trapped volumes also reduce blower displacement and pumping efficiency. Curves ST and HT in the graph of FIG. 5 respectively illustrate the rate of cyclic volume change of the outlet receiver chamber due to trapped volumes for straight and 60° helical twist lobes. As may be seen, the rate of volume change, as a percentage of theoretical displacement due to trapped volumes is approximately 4.5 times greater for straight lobes. The total rate of volume change of the receiver chamber is obtained by adding the associated curves for meshing geometry and trapped volume together.

The alternate configurations or embodiments of the outlet ports illustrated in FIGS. 6–9 differ from outlet port 38 of FIG. 4 mainly in that they include transverse extensions of the transverse and longitudinal boundaries to define the expanding orifices and to increase the outlet port area. Elements or features in FIGS. 6–9 which are substantially the same as those of FIG. 4 are identified by the same numerals prefixed with the Figure number.

Figure 6:
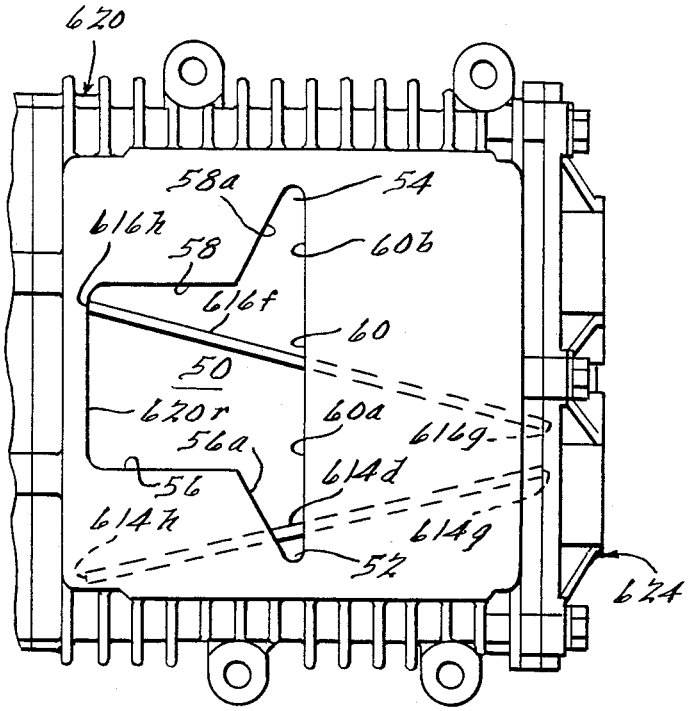
FIGS. 6–9 are reduced views illustrating alternative configurations of the outlet port.

In FIG. 6, the outlet port is designated by numeral 50 and is provided with expanding orifices 52, 54 by transversely extending portion 56*a*, 58*a* of transverse boundaries 56, 58 and portions 60*a*, 60*b* of longitudinal boundary 60. Orifices 52, 54 improve rate control of backflow air into the transfer volumes. By varying convergent angle of the transversely extending portions, and by varying the distance between transverse boundaries 56, 58 and the intersection of the transversely extending portions, backflow of air through expanding orifices 52, 54 may be alternately maintained substantially constant for a 60 rotational degree period of land travel at predetermined speed and differential pressure relationships, thereby negating airborne noise associated with cyclic fluctuations in outlet port pressure. The expanding orifices 52, 54, like orifices 42, 44, remain substantially midway between the land ends of the lobes and therefore allow adequate seal time for the lobe lands.

Figure 7:
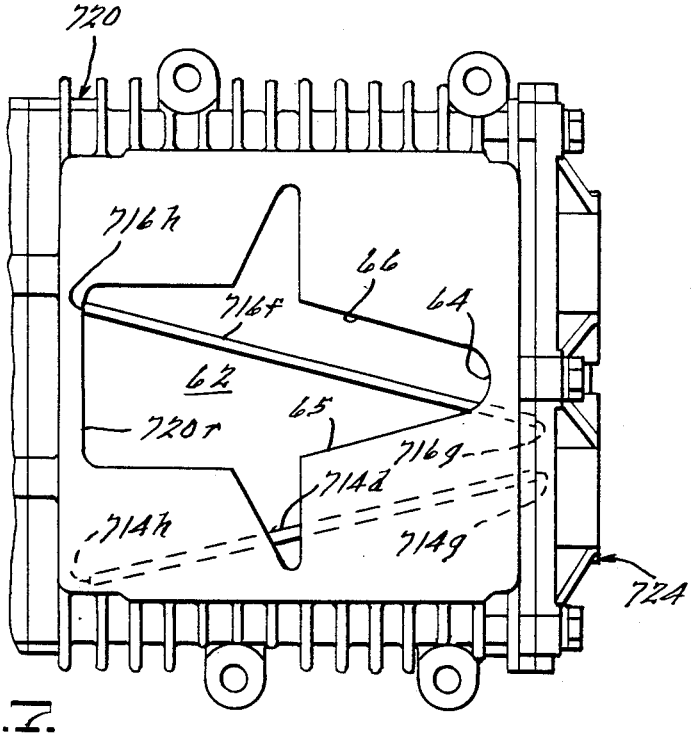

Outlet port 62 of FIG. 7 differs from port 50 of FIG. 6 in that longitudinal boundary portion 64 extends toward lead ends 714*g*, 716*g* of lands 714*d*, 716*f*, and in that transverse boundary portions 65, 66, which are substantially parallel to the lands of the associated lobes, extend between the expanding orifices and longitudinal boundary portion 64. This arrangement increases the outlet port flow area without decreasing the seal time of the lobe lands.

Figure 8:
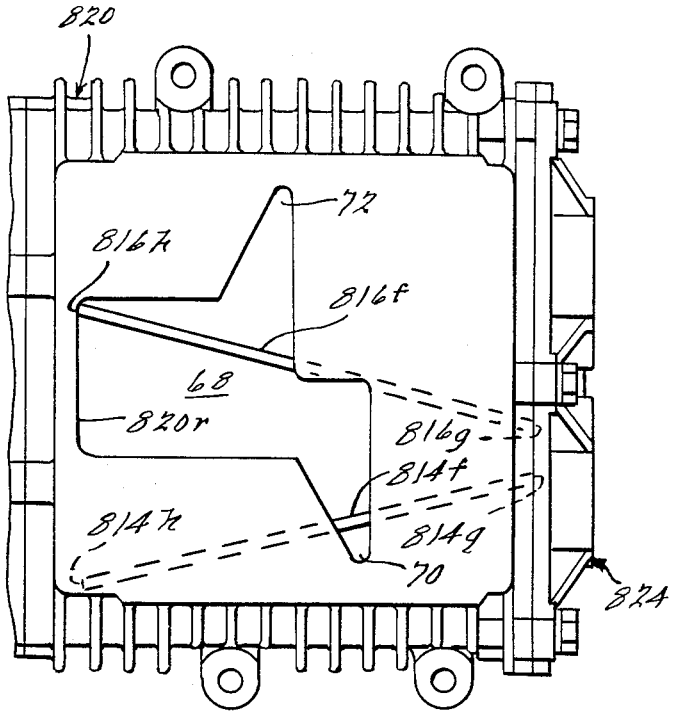

Outlet port 68 of FIG. 8 differs from port 50 of FIG. 6 in that one of the expanding orifices 70, 72 is moved toward the lead ends of the lobe lands. This arrangement varies the timing of backflow pulses, thereby distributing the power of the backflow pulses over different frequencies to reduce noise. Alternatively, expanding orifice 70 may be eliminated.

Figure 9:
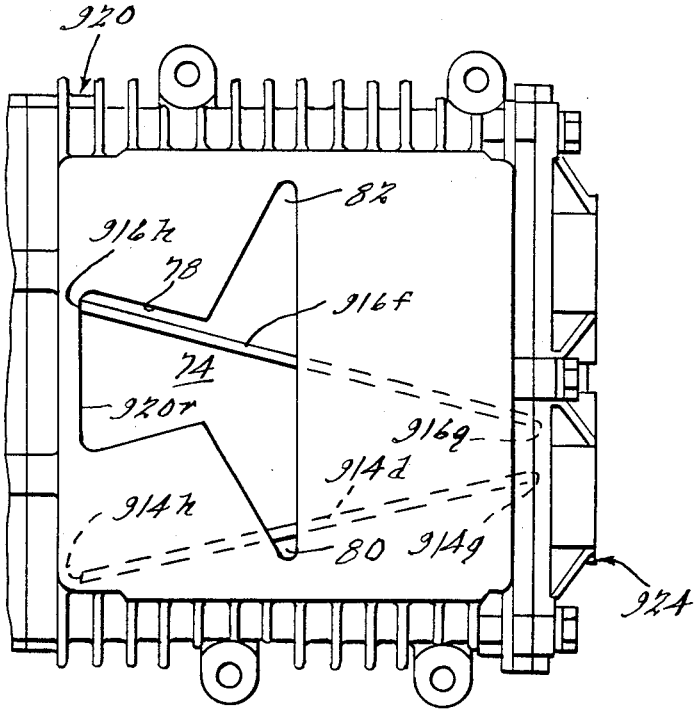

The outlet port 74 of FIG. 9 differs from port 50 of FIG. 6 in that transverse boundaries 76, 78 are disposed substantially parallel to the traversing lands of the associated lobes. With this arrangement, the rotational length of expanding orifices 80, 82 is increased to approximately 60 rotational degrees of the traversing lands without decreasing the seal time of the lands. Alternately, the parallel, transverse boundary portions of FIG. 7 may be replaced with portions 76, 78.

Several embodiments of the invention have been disclosed in detail for illustrative purposes. Many variations of the disclosed embodiments are believed to be within the spirit of the invention. The following claims are intended to cover inventive portions of the disclosed embodiment and modifications believed to be within the spirit of the invention.

What is claimed is:

1. In a rotary blower of the backflow-type including a housing defining two parallel, tranversely overlapping, chambers having cylindrical wall surfaces; an inlet port and an outlet port openings having longitudinal and transverse boundaries defined in opposite sides of the housing with the transverse boundaries of each port disposed on opposite sides of a plane defined by the intersections of the chambers; meshed, lobed rotors disposed in the chambers with the lobes of each rotor having top lands sealingly cooperating with the cylindrical wall surfaces of the associated chamber and operative to traverse the port boundaries disposed on the associated side of the plane for effecting transfer of volumes of compressible inlet port fluid to the outlet port via spaces between adjacent, unmeshed lobes of each rotor; the lobes being formed with a helical twist, whereby each land is helical and has a lead end and a trailing end inthe direction of rotor rotation; the improvement comprising:

the inlet port opening skewed toward the lead ends of the lands;

the outlet port opening skewed toward the trailing ends of the lands, whereby said inlet and outlet port openings are skewed toward opposite ends of said rotors to maximize the number of rotational degrees that the helical lands of each transfer volume sealing cooperate with the cylindrical wall surface of their associated chamber; and means defined by said helical lands and intersecting portions of said outlet port longitudinal and transverse boundaries on either side of said plane for controlling back flow rate of relatively high pressure outlet port fluid to the transfer volumes during initial traversal of said portions by the helical lands and for reducing travel distance of the backflow fluid, said intersecting portions disposed transverse to said helical lands while being traversed and initial traversal of said intersecting portions providing first communication between said high pressure outlet port fluid and said transfer volumes, and the intersection of said intersecting portions disposed substantially midway between the ends of said helical lands and traversed by said helical lands prior to traversal of said plane by the leads ends of said helical lands.

2. The blower of claim 1, wherein the tranverse boundaries of the inlet port are disposed substantially parallel to the traversing lands of the associated lobe.

3. The blower of claim 2, wherein the transverse boundaries of the inlet port are traversed by each land of the associated lobes prior to the trailing end of each land traversing the plane.

4. The blower of claim 1, wherein the lobes are formed with a helical twist substantially equal to the relation 360°/2n, where n equals the number of lobes per rotor.

5. In a rotary blower of the backflow type including a housing defining first and second parallel, transversely overlapping, cylindrical chambers having cylindrical and end wall surfaces; an inlet port and an outlet port openings having longitudinal and transverse boundaries defined in opposite sides of the housing with the transverse boundaries of each port disposed on opposite sides of a plane defined by the intersections of the chambers; first and second meshed, lobed rotors respectively disposed in the first and second chambers with the lobes of each rotor having top lands sealingly cooperating with the cylindrical wall surfaces of the associated chamber and operative to traverse the port boundaries disposed on the associated side of the plane for effecting transfer of volumes of compressible inlet port fluid to the outlet port via spaces between adjacent, unmeshed lobes of each rotor; the lobes being formed with a helical twist, whereby each land is helical and has a lead end and a trailing end in the direction of rotor rotation, the improvement comprising:

the inlet port opening skewed toward the lead ends ofthe lands and having the major portion of the transverse boundary on either side of the plane traversed by the lands of the associated lobes prior to the trailing end of each land traversing the plane; and the outlet port opening skewed toward the trailing ends of the lands, whereby said inlet and outlet port openings are skewed toward opposite ends of said rotors to maximize the number of rotational degrees that the heical lands of each transfer volume sealing cooperate with the cylindrical wall surface of their associated chamber; and means defined by said helical lands and intersecting portions of said outlet port longitudinal and transverse boundaries on either side of said plane for controlling bakcflow rate of relatively high pressure outlet port fluid to the transfer volumes during initial traversal of said portions by the helical lands and for reducing travel distance of the backflow fluid, said intersecting portions disposed transverse to said helical lands while being traversed and initial traversal of said intersecting portions providing first communication between said high pressure outlet port fluid and said transfer volumes, and the intersection of said intersecting portions disposed substantially midway between the ends of said helical lands and traversed by said helical lands prior to traversal of said plane by the lands ends of said helical lands.

6. The blower of claim 5, wherein the lobes are formed with a helical twist substantially equal to the relation 360°/2n, where n equals the number of lobes per rotor.

7. The blower of claim 5, wherein one longitudinal boundary of the outlet port is disposed substantially at the trailing ends of the helical land portions of the lobes and the transverse boundaries defining the outlet port convergently extend from the one longitudinal boundary toward the other longitudinal boundary, and said means is defined by transverse extensions of the transverse boundaries at positions substantially midway between the land ends.

8. The blower of claim 7, wherein the transverse boundary portions on either longitudinal side of said means is substantially parallel to the traversing lands of the associated lobes.

9. The blower of claim 5, wherein one longitudinal boundary of the outlet port is disposed substantially at the trailing ends of the helical land portions of the lobes and the portions of the transverse boundaries between the one longitudinal boundary and said means is substantially parallel to the rotational axes of the rotors, and portions of the transverse boundaries between said means and the other longitudinal boundary are substantially parallel to the traversing lands of the associated lobes.

10. The blower of claim 9, wherein said means on one side of said plane is longitudinally positioned closer to the one longitudinal boundary than said means on the other side of said plane.

11. The blower of claim 5, wherein the boundaries of the outlet port form a substantially rectangular opening having one longitudinal boundary disposed substantially at the trailing ends of the helical lands and the other longitudinal boundary disposed substantially midway between the land ends.

12. The blower of claim 11, wherein at least one of said means is defined by a transverse extension of one transverse boundary and a transverse extension of the other longitudinal boundary.

13. The blower of claim 11, wherein said means is defined by transverse extensions of the transverse boundaries and transverse extensions of the other longitudinal boundary.

* * * * *